US006977369B2

(12) United States Patent
Yamaguchi et al.

(10) Patent No.: US 6,977,369 B2
(45) Date of Patent: Dec. 20, 2005

(54) COLD SPRAY MASS SPECTROMETRIC DEVICE

(75) Inventors: Kentaro Yamaguchi, Chiba (JP); Tatsuji Kobayashi, Akishima (JP)

(73) Assignees: Japan Science and Technology Agency, Kawaguchi (JP); Jeol Ltd., Akishima (JP)

( * ) Notice: Subject to any disclaimer, the term of this patent is extended or adjusted under 35 U.S.C. 154(b) by 477 days.

(21) Appl. No.: 10/343,329

(22) PCT Filed: Jun. 5, 2002

(86) PCT No.: PCT/JP02/05540

§ 371 (c)(1),
(2), (4) Date: Feb. 6, 2003

(87) PCT Pub. No.: WO02/101788

PCT Pub. Date: Dec. 19, 2002

(65) Prior Publication Data

US 2003/0168586 A1 Sep. 11, 2003

(30) Foreign Application Priority Data

Jun. 8, 2001 (JP) ..... 2001-174265

(51) Int. Cl.[7] ..... H01J 49/00

(52) U.S. Cl. ..... 250/281; 250/288; 210/198.2; 210/85; 364/500; 364/557; 73/61.52

(58) Field of Search ..... 250/281, 288; 210/198.2, 85; 364/500, 557; 73/61.52

(56) References Cited

U.S. PATENT DOCUMENTS 5,368,727 A 11/1994 Takahashi et al.
2005/0029442 A1 * 2/2005 Takats et al. ..... 250/281

FOREIGN PATENT DOCUMENTS

JP 10-55776 2/1998
JP 2000-285847 10/2000

* cited by examiner

*Primary Examiner*—Nikita Wells
*Assistant Examiner*—Zia R. Hashmi
(74) *Attorney, Agent, or Firm*—Westerman, Hattori, Daniels & Adrian, LLP

(57) ABSTRACT

The instrument cold sprays a solution sample at a low temperature and desolvates the sample. Under this condition, a mass analysis is performed. The instrument comprises a needle pipe (8) through which the solution sample is passed, a sheath tube (24) formed coaxially with the needle pipe (8) and passing a temperature-controlled nebulizing gas therethrough, the above-described desolvation block (3), means for cooling the block (15), means for heating the block (4), and a temperature sensor (5) for detecting the temperature of the block (3). The block (3) has a passage for charged liquid droplets of the solution sample cold sprayed from the tip of the needle pipe (8), and acts to remove the solvent from the charged liquid droplets flowing through the passage. A coldspray mass spectrometer is offered which has a desolvation block whose temperature can be easily controlled. In the instrument, condensation of water and electrical leakage are prevented for a long time. The instrument can perform measurements stably and is easy to handle.

9 Claims, 3 Drawing Sheets

COLD SPRAY MASS SPECTROMETRIC DEVICE

TECHNICICAL FIELD

The present invention relates to a mass spectrometer and, more particularly, to a coldspray mass spectrometer capable of ionizing samples at low temperatures.

BACKGROUND ART

Where an electrically conducting liquid is placed within a strong electric field, the liquid spontaneously sprays out of the tip of a capillary tube by the action of the field. This phenomenon is termed electrospray and has been known for many years. The electrospray phenomenon was applied to mass spectrometry of samples in solution form in the former half of 1980s and has come to be widely used in electrospray mass spectrometers.

Referring to FIG. 1, there is shown a conventional electrospray mass spectrometer for use with a sample source 31 for supplying a sample in solution form, e.g., a liquid chromatograph (LC) or solution tank. This solution sample (e.g., an LC mobile phase) from the sample source 31 is sent to a capillary 32 by a pump (not shown). This capillary 32 is made of a metal and has an inside diameter of 30 to 100 $\mu$m and an outside diameter of 150 to 250 $\mu$m. The sample pumped into the capillary 32 is driven by an LC pump or capillarity, sucked into the capillary 32, and reaches the tip of the capillary 32.

A high voltage of several kilovolts is applied between the capillary 32 and the counter electrode 34 of the mass spectrometer 33 to produce a strong electric field. The solution sample in the capillary 32 is electrostatically sprayed into the space between the capillary 32 and the counter electrode 34 under atmospheric pressure and disperses into the air as charged liquid droplets. At this time, the flow rate of the solution sample is 1 to 10 microliters per minute. Since the produced charged liquid droplets are clusters formed by solvent molecules collected around sample molecules, only ions of the sample molecules can be left if heat is applied to evaporate off the solvent molecules.

One method of creating sample ions from charged liquid droplets consists of heating nitrogen gas to about 70° C., supplying the hot gas into the space between the capillary 32 and the counter electrode 34, and electrostatically spraying the droplets into the space to evaporate off the solvent of the liquid droplets. Another method consists of heating a sampling orifice 35 formed in the counter electrode 34 of the mass spectrometer 33 to about 80° C. and evaporating off the solvent of the liquid droplets by the resulting radiative heat or thermal conduction. These methods are known as ion evaporation.

Sample ions created by ion evaporation are accepted into the mass spectrometer 33 through the sampling orifice 35 formed in the counter electrode 34. To introduce the sample ions under atmospheric pressure, differentially pumped walls are formed. In particular, a partition surrounded by the sampling orifice 35 and a skimmer orifice 36 is evacuated to about 200 Pa by a rotary pump (RP) (not shown). Meanwhile, a partition surrounded by the skimmer orifice 36 and a partition wall 37 is evacuated to about 1 Pa by a turbomolecular pump (TMP) (not shown). The stage located behind the partition wall 37 is evacuated to about $10^{-3}$ Pa by the TMP, and a mass analyzer 38 is placed in this stage.

A ring lens 39 is placed in a low-vacuum partition surrounded by the sampling orifice 35 and the skimmer orifice 36. A voltage that is positive or negative is applied to the ring lens 39, depending on whether the sample ions are positive or negative, respectively, to prevent diffusion of the sample ions. An ion guide 40 to which an RF voltage is applied is placed in a moderate-vacuum partition surrounded by the skimmer orifice 36 and the partition wall 37 to guide sample ions into the mass analyzer 38.

In a modern system based on the instrument shown in FIG. 1, a sheath tube (not shown in FIG. 1) through which a nebulizing gas can flow is mounted around the capillary 32, thus coping with a high flow rate of sample such as 10 to 1000 microliters/min as encountered with an LC mobile phase. In this new type of electrospray ion source, a high flow rate of solution sample more than 10 microliters/min that cannot be fully nebulized by electric field force alone can be fully nebulized by the force of the nebulizing gas.

An electrospray ion source is characterized in that it provides a very soft ionization method which utilizes neither application of high temperature nor bombardment of high-energy particles in ionizing sample molecules. Therefore, highly polar biomolecular polymers such as peptide, proteins, and nucleic acids can be readily ionized into polyvalent ions almost nondestructively. Furthermore, since they are polyvalent ions, they can be investigated with a relatively small-sized mass spectrometer even if the molecular weight is in excess of ten thousands.

In recent years, however, some examples of samples have been reported in which the molecular structure of sample ions is destroyed even if they are ionized by a very soft ionization method such as electrospray ionization. One example is a huge organic-metal complex typified by a supramolecular compound having a high degree of orderliness because of self-assembly of transition metal (such as platinum)-complex. These metal complexes are unstable against ionization provided by electrospray that is a soft ionization method, as well as against ion bombardment and heat. Consequently, during ionization, the molecular structure is destroyed.

In an attempt to solve this problem, a new type of electrospray mass spectrometer has been developed (Japanese patent laid-open No. 2000-285847). In particular, a nebulizing gas supplied into an electrospray ion source and a desolvation chamber for charged particle droplets are cooled by a refrigerant such as liquid nitrogen to minimize the heat applied to sample ions during ionization. This cooling device promotes electrolytic dissociation to form molecular ions base on increasing polarizability of the compounds and/or solvent molecules caused by the higher dielectic constant at low temperature. This method is known as coldspray ionization, and has first succeeded in accurately measuring the mass numbers of unstable self-assembling organic-metal complexes as mentioned previously by directly spraying liquid nitrogen against the desolvation chamber, as shown in FIG. 2.

Undoubtedly, the feature of such a coldspray mass spectrometer is that the nebulizing gas and desolvation chamber are cooled by a refrigerant such as liquid nitrogen to minimize the application of heat to charged liquid droplets. In the prior art instrument, however, the desolvation chamber is directly cooled by liquid nitrogen and so overcooling occurs. This makes it difficult to set the desolvation chamber to a temperature range best adapted for measurements. It takes a long time until the instrument stabilizes. Furthermore, the cooling gas for cooling the desolvation chamber directly flows into the ionization chamber, thus disturbing the air flow in the chamber. Consequently, it is difficult to stabilize the ion beam. In addition, when a measurement is being performed by the coldspray ionization method, isolation from the outside environment is not complete and so dewing occurs inside a chamber accommodating electrical circuitry. This results in electrical leakage, which in turn makes it difficult to perform stable measurements for a long time. Another problem is that it is impossible to switch the mode of operation between coldspray ionization mode and normal electrospray ionization mode.

DISCLOSURE OF THE INVENTION

In view of the foregoing problems, the present invention has been made. It is an object of the present invention to provide a coldspray mass spectrometer which is easy to handle, is capable of preventing condensation of water and electrical leakage for a long time, and has a desolvation block whose temperature can be easily controlled, thus permitting stable measurements.

This object is achieved by a coldspray mass spectrometer built in accordance with the present invention, the spectrometer being designed to perform a mass analysis by spraying a solution sample at a low temperature and desolvating the sample, the spectrometer comprising (a) a needle pipe through which the solution sample is passed, (b) a sheath tube which is formed coaxially with the needle pipe and through which a temperature-controlled nebulizing gas is passed, (c) a desolvation block having a passageway extending from the tip of the needle pipe, the passageway permitting passage of charged liquid droplets of the solution sample, the desolvation block acting to remove solvent from the charged liquid droplets passing through the passageway, (d) cooling means for cooling the desolvation block, (e) heating means for heating the desolvation block, and (f) a temperature sensor for detecting the temperature of the desolvation block. The desolvation block can be controlled to any desired temperature.

Other objects and features of the invention will appear in the course of the description thereof, which follows.

BEST MODES FOR CARRYING OUT THE INVENTION

Preferred embodiments of the present invention are hereinafter described with reference to the accompanying drawings.

Figure 1:
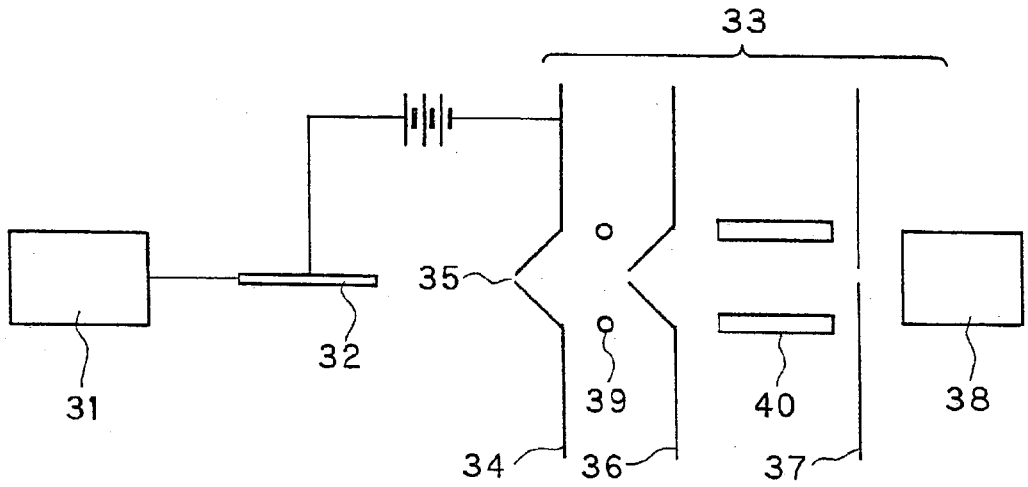
FIG. 1 is a diagram of a conventional electrospray mass spectrometer.
Figure 2:
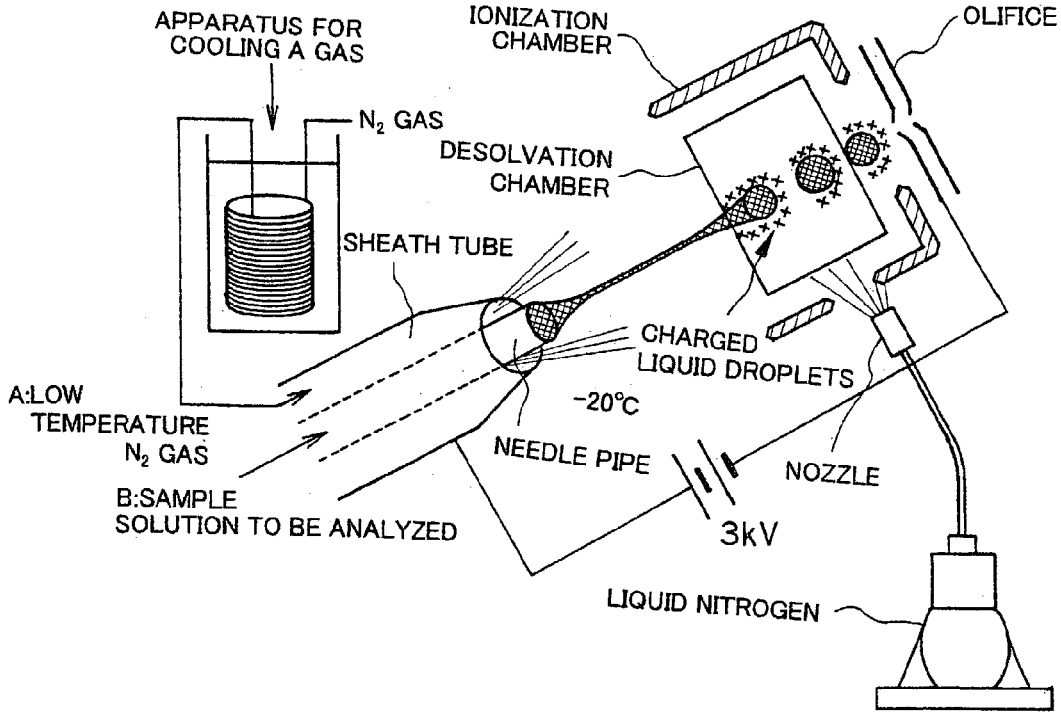
FIG. 2 is a diagram of a conventional coldspray mass spectrometer.
Figure 3A:
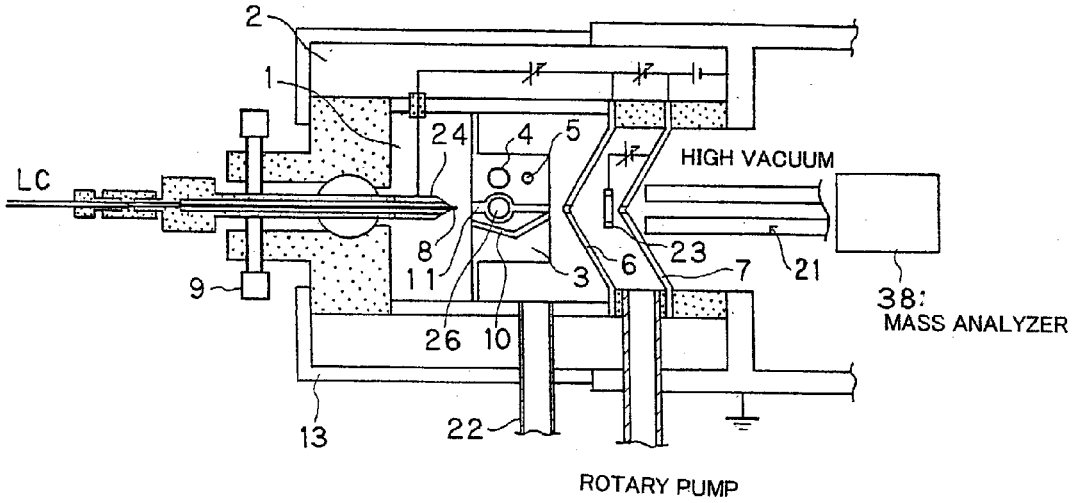
FIG. 3 is a diagram of a coldspray mass spectrometer according to the present invention.
Figure 3B:
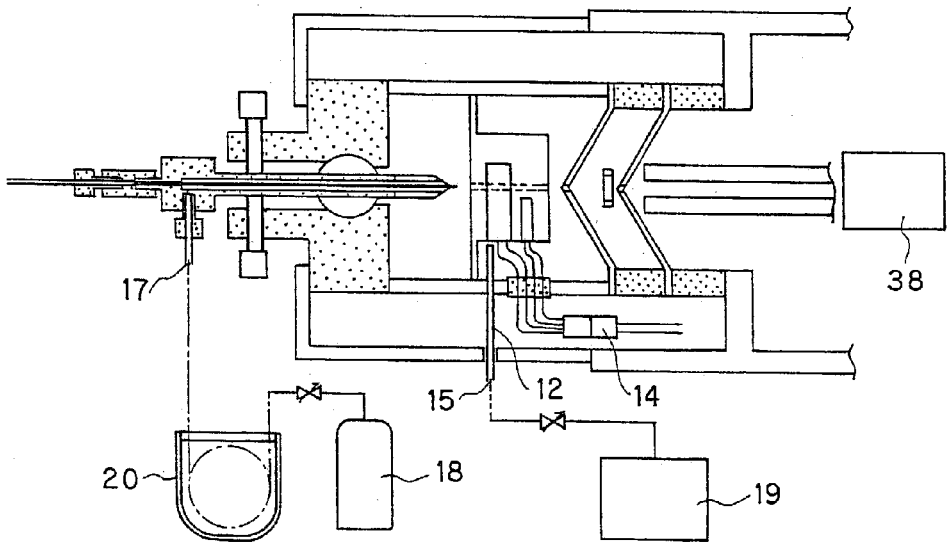

Referring to FIGS. 3(*a*) and 3(*b*), there is shown a coldspray mass spectrometer according to one embodiment of the present invention. FIG. 3(*a*) is a top plan view of the mass spectrometer. FIG. 3(*b*) is a side elevation of the instrument. This spectrometer has an ionization chamber 1 including a needle pipe 8 and a desolvation block 3. A high voltage is applied to the needle pipe 8 to electrostatically spray a solution sample. The desolvation block 3 is used to desolvate charged liquid droplets electrostatically sprayed from the tip of the needle pipe 8. The needle pipe 8 incorporates a sheath tube 24 mounted coaxially with the needle pipe 8, thus forming a double tube. A nebulizing gas that helps electrostatic spraying flows through the sheath tube 24. A heater 4 for heating the desolvation block 3 and a temperature sensor 5 for detecting the temperature of the desolvation block 3 are buried in the wall of the block 3.

The desolvation block 3 is provided with a heating passage hole 10 to desolvate the charged liquid droplets at a high temperature. The block 3 is also provided with a cooling passage hole 11 to desolvate the liquid droplets at a low temperature. The position of the tip of the needle pipe 8 can be switched between a position on the side of the entrance of the heating passage hole 10 and a position on the side of the entrance of the cooling passage hole 11 by a position-adjusting knob 9, to permit the user to select between normal electrospray ionization and coldspray ionization. A bypass rod 26 is mounted in the cooling passage hole 11 to bypass the charged liquid droplets; otherwise, the electrostatically sprayed liquid droplets would immediately reach the first orifice 6.

After the desolvation, the solvent will condense on the wall of the ionization chamber 1. This condensed solvent and excess portion of the solution sample sprayed from the needle pipe 8 are discharged to an external drain (not shown) from the ionization chamber 1 through a drainage line 22.

To introduce ions of the sample desolvated by the desolvation block 3 at atmospheric pressure into the vacuum of the mass spectrometer, differentially pumped walls are formed. In particular, a partition surrounded by the first orifice 6 and the second orifice 7 is evacuated to about 200 Pa by a rotary pump (RP) (not shown). A partition surrounded by the second orifice 7 and a partition wall (not shown) is evacuated to about 1 Pa by a turbomolecular pump (TMP) (not shown). A stage (not shown) located behind this partition wall (not shown) is evacuated to about $10^{-3}$ Pa by the TMP, and a mass analyzer (not shown) is placed in this stage.

The sample desolvated by the desolvation block 3 and turned into ions is accepted into the mass spectrometer from the first orifice 6. A ring lens 23 is placed in the low-vacuum partition surrounded by the first orifice 6 and the second orifice 7 to prevent diffusion of the sample ions. A voltage that is positive or negative is applied to the ring lens 23, depending on whether the sample ions are positive or negative, respectively, to prevent diffusion of the sample ions. An ion guide 21 is placed in a moderate-vacuum partition surrounded by the second orifice 7 and a partition wall (not shown) to guide the sample ions into the mass analyzer 38. An RF voltage is applied to the ion guide 21.

Where measurements are performed in the coldspray ionization mode, nebulizing nitrogen gas 17 supplied from a nitrogen bottle 18 is cooled to about −20° C. by a refrigerator jar 20 and then ejected from the sheath tube 24. Cooling nitrogen gas 15 supplied from a liquid nitrogen jar 19 is blown directly against the wall of the desolvation block 3 through an insulating pipe 12 to lower the temperature of the desolvation block 3. During measurement, control is provided such that no heat is applied to the charged liquid droplets of the sample. At this time, the position of the tip of the needle pipe 8 is aligned to the cooling passage hole 11 by the position-adjusting knob 9. The charged liquid droplets pass through the cooling passage hole 11 and thus are desolvated. To stabilize the temperature of the desolvation block 3, the heater 4 may be appropriately operated while cooling the block by the cooling nitrogen gas 15.

Where a measurement is performed in normal electrospray ionization mode, nebulizing nitrogen gas 17 supplied from the nitrogen bottle 18 is ejected from the sheath tube 24 while maintaining the gas at room temperature. Supply of the cooling nitrogen gas 15 from the liquid nitrogen jar 19 is cut off. The desolvation block 3 is heated to 100–300° C. by the heater 4. During measurement, control is provided such that heat is applied to the charged liquid droplets of the sample. At this time, the position of the tip of the needle pipe 8 is aligned to the heating passage hole 10 by the position-adjusting knob 9. The droplets pass through the heating passage hole 10. Thus, they are desolvated. In this way, in the present embodiment, the mode of operation can be switched arbitrarily between the coldspray ionization mode and the normal electrospray ionization mode.

A second chamber 2 surrounded by a case 13 is formed around the ionization chamber 1. Wires for a high-voltage source for applying high voltages to the needle pipe 8, the first orifice 6, the second orifice 7, and so on are held in this chamber 2. Furthermore, wire connectors 14 for the heater 4 and temperature sensor 5 are held in the second chamber 2. Dry purge gas is kept supplied into this chamber 2 from a gas source (not shown) to prevent introduction of moisture from the outside; otherwise, dewing would occur when the desolvation block 3 is cooled.

Figure 4A:
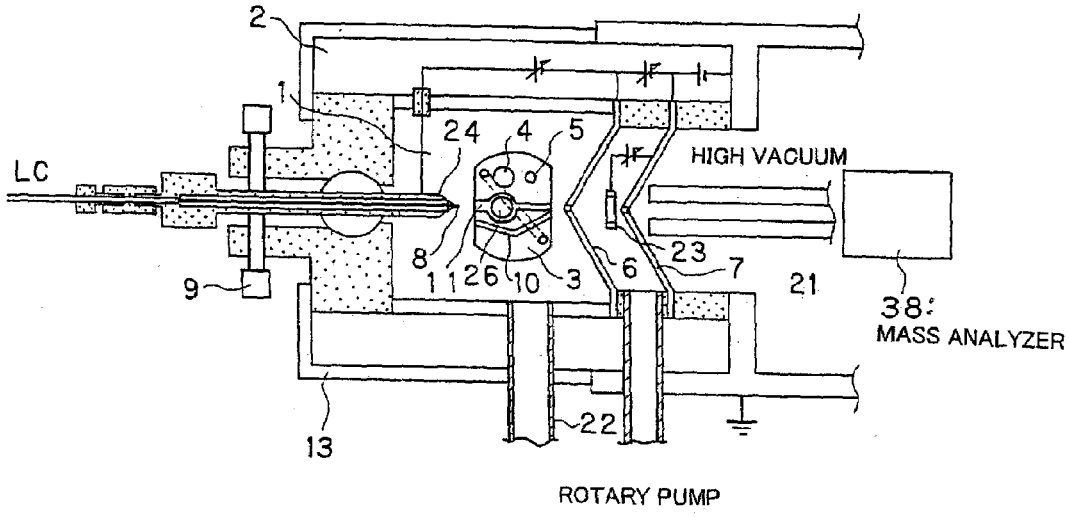
FIG. 4 is a diagram of another coldspray mass spectrometer according to the invention.
Figure 4B:
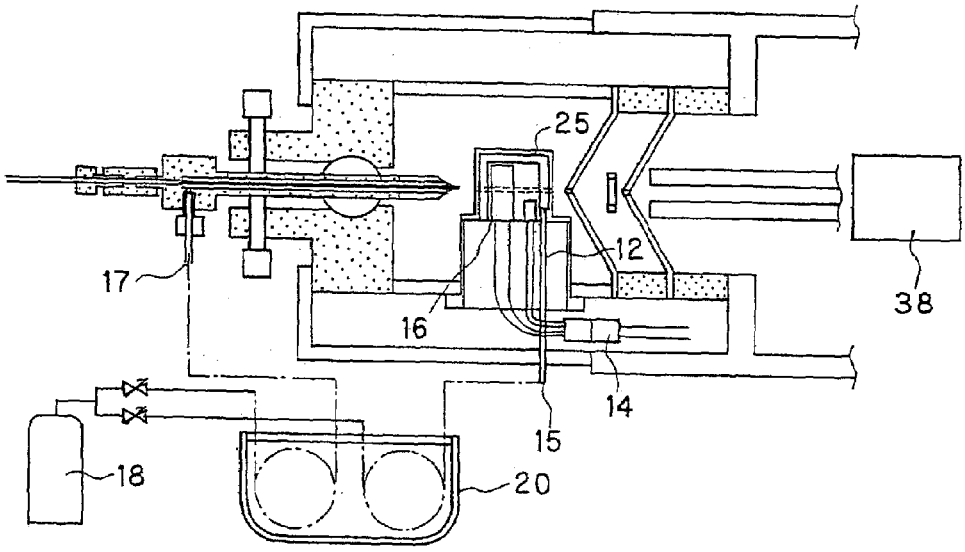

FIGS. 4(*a*) and 4(*b*) show another coldspray mass spectrometer according to the invention. FIG. 4(*a*) is a top plan view of the instrument. FIG. 4(*b*) is a side elevation of the instrument. This mass spectrometer has an ionization chamber 1 containing a needle pipe 8 and a desolvation block 3. A high voltage is applied to the needle pipe 8 to electrostatically spray a solution sample. The desolvation block 3 is used to desolvate charged liquid droplets electrostatically sprayed from the tip of the needle pipe 8. A sheath tube 24 for conveying a nebulizing gas that assists electrostatic spraying is mounted coaxially inside the needle pipe 8. Thus, a double tube is formed. A heater 4 for heating the desolvation block 3 and a temperature sensor 5 for detecting the temperature of the block 3 are buried in the wall of the desolvation block 3.

The desolvation block 3 is formed with a heating passage hole 10 for desolvating the charged liquid droplets at a high temperature. The block 3 is also provided with a cooling passage hole 11 for desolvating the charged liquid droplets at a low temperature. The position of the tip of the needle pipe 8 can be switched between the entrance side of the heating passage hole 10 and the entrance side of the cooling passage hole 11 by the position-adjusting knob 9. This permits one to select between the normal electrospray ionization and the coldspray ionization. A bypass rod 26 is mounted in the cooling passage hole 11 to bypass the charged liquid droplets; otherwise, the electrostatically sprayed liquid droplets would immediately reach the first orifice 6.

After the desolvation, the solvent will condense on the wall of the ionization chamber 1. This condensed solvent and excess portion of the solution sample sprayed from the needle pipe 8 are discharged to an external drain (not shown) from the ionization chamber 1 through a drainage line 22.

To introduce the sample ions desolvated by the desolvation block 3 under atmospheric pressure into the vacuum of the mass spectrometer, differentially pumped walls are formed. In particular, a partition surrounded by a first orifice 6 and a second orifice 7 is evacuated to about 200 Pa by a rotary pump (RP) (not shown). Meanwhile, a partition surrounded by the second orifice 7 and a partition wall (not shown) is evacuated to about 1 Pa by a turbomolecular pump (TMP) (not shown). The stage located behind the partition wall (not shown) is evacuated to about $10^{-3}$ Pa by the TMP, and a mass analyzer (not shown) is placed in this stage.

The sample desolvated by the desolvation block 3 and turned into ions is accepted into the mass spectrometer from the first orifice 6. A ring lens 23 is placed in the low-vacuum partition surrounded by the first orifice 6 and the second orifice 7. A voltage that is positive or negative is applied to the ring lens 23, depending on whether the sample ions are positive or negative, respectively, to prevent diffusion of the sample ions. An ion guide 21 is placed in a moderate-vacuum partition surrounded by the second orifice 7 and the partition wall (not shown) to guide the sample ions into the mass analyzer 38. An RF voltage is applied to the ion guide 21.

Where measurements are performed in the coldspray ionization mode, nebulizing nitrogen gas 17 supplied from a nitrogen bottle 18 and cooling nitrogen gas 15 are cooled to about −20° C. by a common refrigerator jar 20 and then supplied into the sheath tube 24 and into a refrigerant passage 25 formed in the wall of the desolvation block 3, thus cooling the needle pipe 8 and the desolvation block 3 at the same time. Therefore, in the present embodiment, the cooling nitrogen gas 15 flows in the refrigerant passage 25. Consequently, the gas flow in the ionization chamber 1 is less disturbed compared with the method consisting of directly blowing liquid nitrogen against the desolvation block 3. Hence, an ion beam can be supplied stably. At this time, the position of the tip of the needle pipe 8 is aligned to the cooling passage hole 11 by the position-adjusting knob 9. The charged liquid droplets pass through the cooling passage hole 11 and thus are desolvated. To stabilize the temperature of the desolvation block 3, a heater 4 may be appropriately operated while cooling the block by the cooling nitrogen gas 15.

Where a measurement is performed in normal electrospray ionization mode, nebulizing nitrogen gas 17 supplied from the nitrogen bottle 18 is ejected from the sheath tube 24 while maintaining the gas at room temperature. Supply of the cooling nitrogen gas 15 from the liquid nitrogen jar 19 is cut off. The desolvation block 3 is heated to 100–300° C. by the heater 4. During measurement, control is provided such that heat is applied to the charged liquid droplets of the sample. At this time, the position of the tip of the needle pipe 8 is aligned to the heating passage hole 10 by the position-adjusting knob 9. The droplets pass through the heating passage hole 10. Thus, they are desolvated. In this way, in the present embodiment, the mode of operation can be switched arbitrarily between the coldspray ionization mode and normal electrospray ionization mode.

A second chamber 2 surrounded by a case 13 is formed around the ionization chamber 1. Wires for a high-voltage source for applying high voltages to the needle pipe 8, the first orifice 6, the second orifice 7, and so on are held in this chamber 2. Furthermore, wire connectors 14 for the heater 4 and temperature sensor 5 are held in the second chamber 2. Where measurements are performed in the coldspray ionization mode, the cooling dry nitrogen gas 15 flowing through a refrigerant passage 25 formed in the wall of the desolvation block 3 is admitted into, and circulated through, the second chamber 2 via a cooling gas exit 16. The inside of the second chamber 2 is purged by making effective use of the used dry nitrogen gas 15 for cooling.

This prevents introduction of moisture from the outside into the second chamber 2 when the ionization chamber 1 is cooled in the coldspray ionization mode; otherwise, dewing would occur inside the second chamber. Electrical leakage from the wires for the high-voltage source for applying high voltages to the needle pipe 8, first orifice 6, second orifice 7, etc. and from the wire connectors 14 for the heater 4 and temperature sensor 5 is prevented.

In the above embodiments, cheap nitrogen gas is used as a cooling gas. Inert gases other than nitrogen gas may also be used. The dry gas introduced in the second chamber of the second embodiment is not always a used cooling gas. A separate gas source may be provided. The cooling gas may also be cooled by a cooling means other than a refrigerator, e.g., a dry ice bath consisting of a combination of dry ice and an organic solvent. Furthermore, the refrigerant passage 25 is not always required to be formed in the wall of the desolvation block 3. The passage may be formed anywhere near the desolvation block 3 as long as effective cooling of the block 3 is achieved. In addition, the refrigerant for cooling the desolvation block 3 is not always an expendable gas. A temperature-controlled fluid may be circulated in use.

In the above-described coldspray ionization mode, it is confirmed that the solution sample sprayed from the tip of the needle pipe 8 is ionized even if a high voltage is not applied to the needle pipe 8. Accordingly, application of the high voltage to the needle pipe 8 is not essential for the ionization of the solution sample.

The above-described nebulizing gas may be used as the means for cooling the desolvation block described above. In this case, the cooling nitrogen gas 15 does not need to be sprayed against the block wall in the embodiment described in connection with FIG. 3. In the embodiment described in connection with FIG. 4, it is not necessary to force the cooling nitrogen gas 15 through the refrigerant passage 25 in the desolvation block 3.

INDUSTRIAL APPLICABILITY

As described thus far, the coldspray mass spectrometer according to the present invention comprises means for cooling and/or heating the desolvation block and a temperature sensor for detecting the temperature of the desolvation block. The second chamber 2 where electrical wires are accommodated is purged with a dry gas and so it is easy to control the temperature of the desolvation block 3. Furthermore, water condensation and electrical leakage can be prevented for a long time. The coldspray mass spectrometer can perform measurements stably and is easy to handle.

What is claimed is:

1. A coldspray mass spectrometer for performing a mass analysis by spraying a solution sample at a low temperature and desolvating the sample, said coldspray mass spectrometer comprising:

(a) a needle pipe through which the solution sample is passed;

(b) a sheath tube which is formed coaxially with the needle pipe and through which a temperature-controlled nebulizing gas is passed;

(c) a desolvation block having a passageway extending from a tip of the needle pipe, the passageway permitting passage of charged liquid droplets of the solution sample, the desolvation block acting to remove a solvent from the charged liquid droplets passing through the passageway;

(d) cooling means for cooling the desolvation block;

(e) heating means for heating the desolvation block; and (f) a temperature sensor for detecting the temperature of the desolvation block;

wherein said desolvation block can be controlled to any desired temperature.

2. A coldspray mass spectrometer for performing a mass analysis by spraying a solution sample at a low temperature and desolvating the sample, said coldspray mass spectrometer comprising:

(a) a needle pipe through which the solution sample is passed;

(b) a sheath tube which is formed coaxially with the needle pipe and through which a temperature-controlled nebulizing gas is passed;

(c) a desolvation block having a passageway extending from a tip of the needle pipe, the passageway permitting passage of charged liquid droplets of the solution sample, the desolvation block acting to remove a solvent from the charged liquid droplets passing through the passageway;

(d) cooling means for cooling the desolvation block;

(e) heating means for heating the desolvation block; and (f) a temperature sensor for detecting the temperature of the desolvation block;

wherein mode of operation of the mass spectrometer can be switched between coldspray ionization mode and normal electrospray ionization mode.

3. A coldspray mass spectrometer as set forth in claim 1 or 2, wherein said desolvation block has a heating passage for desolvating said charged liquid droplets at a high temperature and a cooling passage for desolvating said charged liquid droplets at a low temperature, and wherein a passage for said charged liquid droplets can be selected between said heating passage and said cooling passage.

4. A coldspray mass spectrometer as set forth in claim 3, wherein anyone of said heating passage and said cooling passage is selected by moving said needle pipe.

5. A coldspray mass spectrometer as set forth in claim 1 or 2, wherein a refrigerant passage is formed in said desolvation block, and wherein a refrigerant is passed through said refrigerant passage to thereby cool said desolvation block.

6. A coldspray mass spectrometer as set forth in claim 1 or 2, wherein the temperature-controlled nebulizing gas supplied into the sheath tube and a refrigerant supplied into said means for cooling the desolvation block are supplied from a common refrigerator.

7. A coldspray mass spectrometer as set forth in claim 1 or 2, wherein a space for accommodating an electrical circuit for controlling a coldspray ion source is formed separately from an ionization chamber in which said desolvation block is placed.

8. A coldspray mass spectrometer as set forth in claim 7, wherein a refrigerant already used to cool the desolvation block is discharged to the outside through said space.

9. A coldspray mass spectrometer as set forth in claim 7, further comprising a gas source for supplying a dry gas into said space.

* * * * *